US006854364B1

(12) United States Patent
Tassano et al.

(10) Patent No.: US 6,854,364 B1
(45) Date of Patent: Feb. 15, 2005

(54) SCREW HOOK SOCKET

(76) Inventors: James Tassano, 21570 American River Dr., Sonora, CA (US) 95370; Eric L. Willson, 12132 Campo Seco Rd., Sonora, CA (US) 95370

( * ) Notice: Subject to any disclaimer, the term of this patent is extended or adjusted under 35 U.S.C. 154(b) by 0 days.

(21) Appl. No.: 10/731,609

(22) Filed: Dec. 8, 2003

Related U.S. Application Data

(60) Provisional application No. 60/492,504, filed on Aug. 4, 2003.

(51) Int. Cl.[7] ..... B25B 13/06
(52) U.S. Cl. ..... 81/121.1; 81/176.1; 81/901
(58) Field of Search ..... 81/121.1, 176.1, 81/901

(56) References Cited

U.S. PATENT DOCUMENTS 4,436,004 A * 3/1984 Chang ..... 81/60
D319,764 S * 9/1991 McCord, Jr. ..... D8/70
D376,520 S * 12/1996 Morin ..... D8/14
5,622,090 A 4/1997 Marks ..... 81/185
6,374,707 B1 * 4/2002 Browning ..... 81/119
6,543,959 B1 4/2003 Jore ..... 403/322.2

* cited by examiner

*Primary Examiner*—Joseph J. Hail, III
(74) *Attorney, Agent, or Firm*—Kevin D. Jablonski

(57) ABSTRACT

A tool comprising a drive shaft with a longitudinal axis and a socket attached to the drive shaft. The socket includes a cavity having a substantially rectangular opening defined by a pair of parallel side walls of the first side length and a U-shaped wall having two parallel walls adjacent to the opening and a curved portion of the U-shaped wall opposite the opening. In this manner, the cavity is shaped to fit the contour of a typical screw hook such that the screw hook can be anchored to a wall or ceiling with relative ease because the screw hook will not rotate away from the longitudinal axis of the tool.

15 Claims, 3 Drawing Sheets

SCREW HOOK SOCKET

CROSS REFERENCE TO RELATED APPLICATION

This application claims priority from U.S. Provisional Application 60/492,504 titled, "ROUND SCREW HOOK FOR EXTENSION POLE," which was filed on Aug. 4, 2003, and which is incorporated by reference.

BACKGROUND OF THE INVENTION

A conventional screw hook 100, shown in FIG.1, is essentially a hook with a screw attached to the hook. Screw hooks 100 are used widely for anchoring a support point to a wall or ceiling in order to hang any number of objects from the hook portion 110 of the screw hook 100. The hook portion 110 allows one the convenience of hanging and unhanging objects without having to unanchor the screw hook 100 from the wall or ceiling. This convenience has led to the wide use of screw hooks 100 in many applications including, for example, hanging plants, Christmas lights, and television cable.

The screw hook 100 of FIG. 1 comprises a threaded (shank) portion 105 and the hook portion 110. The hook portion 110 is further defined by two straight runs 120 and 121 coupled by a curved run 122. The first straight run 120 forms a first member of the hook portion 110 which is attached to a bend point 140 of the shank portion 105 and the second straight run 121 forms the tip 141 of the hook portion 110 such that an opening 130 is formed. The opening 130 allows an object, such as a hanging wire or rope, to be inserted. Typically, the two straight runs 120 and 121 are parallel to each other.

When anchoring the screw hook 100 to a wall or ceiling, rotational torque is applied to the screw hook 100 such that the threaded shank 105 engages the wall or ceiling. That is, the screw hook 100 is screwed into the wall. In some cases, a human hand can provide enough rotational torque to engage the threads with the wall. However, this is not always the case and a tool is typically required to increase the amount of rotational torque able to be applied to the screw hook 100. Further, a tool is also required if the location that the screw hook 100 will be installed is not accessible (too high, for example) by a human.

One such tool used in the past is a pair of pliers (not shown). Pliers can secure the screw hook 100 in its fingers in order to provide more rotational torque to the screw hook 100. This tool, however, is only able to rotate as far as the human hand can rotate in one motion before the fingers must release the screw hook 100 and then engage it again before being able to rotate the screw hook 100 again. It is often the case that one rotational motion of the human hand is not enough for the screw hook's threads 105 to engage the surface enough to support its own weight. As such, the screw hook 100 falls out when the fingers of the pliers are released. Furthermore, pliers require one to be in close proximity to the location that the screw hook 100 is being installed. Therefore, pliers are not a viable solution when the location to install the screw hook 100 is a high ceiling.

Another tool that may be used to assist in installing a screw hook 100 is a scalloped interior socket tool (also not shown), such as the one described in U.S. Pat. No. 5,622,090, filed on Apr. 16, 1996 to Marks and assigned to WorkTools, Inc. of Chatsworth, Calif. Using this socket, fingers inside the socket retract to form a "pocket" around an object. In this fashion, any shape of object can be engaged and rotational torque can be applied.

The retractable fingers, however, are biased outward. As such, when trying to anchor a screw hook 100, one must hold the screw hook 100 in the socket when installing. Otherwise the retractable fingers, being biased outward will push the screw hook 100 out of the socket before one can position the screw hook shank 105 against the wall. This will not work for situations when the screw hook 100 must be anchored on a high ceiling where one cannot hold the screw hook 100 in place until the shank's threads 105 engage the ceiling.

Furthermore, because the retractable fingers are parallel to the longitudinal axis of the screw hook shank 105, the screw hook 100 may rotate away from the longitudinal axis of the socket. That is, the socket does not apply a force to the hook portion 110 in order to keep the screw hook shank 105 from rotating one way or another. As a result, the socket is not capable of maintaining the longitudinal axis of the shank 105 in alignment with its own longitudinal axis before the shank 105 engages the wall or ceiling.

Therefore, it would be beneficial to have a tool that applies the proper forces to the hook portion 110 of the screw hook 100 in order to maintain parallel longitudinal axes of rotation (both the shank and the tool) while a screw hook 100 is being anchored.

SUMMARY OF THE INVENTION

An embodiment of the invention is a tool comprising a drive shaft with a longitudinal axis and a socket attached to the drive shaft. The socket includes a cavity having a substantially rectangular opening defined by a pair of parallel side walls of the first side length and a U-shaped wall having two parallel walls adjacent to the opening and a curved portion of the U-shaped wall is opposite the opening. In this manner, the cavity is shaped to fit the contour of a typical screw hook such that the screw hook can be anchored to a wall or ceiling with relative ease because the screw hook will not rotate away from the longitudinal axis of the tool.

Because screw hooks typically have straight parallel runs in the hook portion of the screw hook, the cavity that engages the screw hook is able to apply forces in directions that are not perpendicular to the longitudinal axis of the screw hook. As such, the screw hook will not rotate when engaged with the screw hook socket tool.

BRIEF DESCRIPTION OF THE DRAWINGS

The foregoing aspects and many of the attendant advantages of this invention will become more readily appreciated as the same become better understood by reference to the following detailed description, when taken in conjunction with the accompanying drawings, wherein.

DETAILED DESCRIPTION

Figure 1:
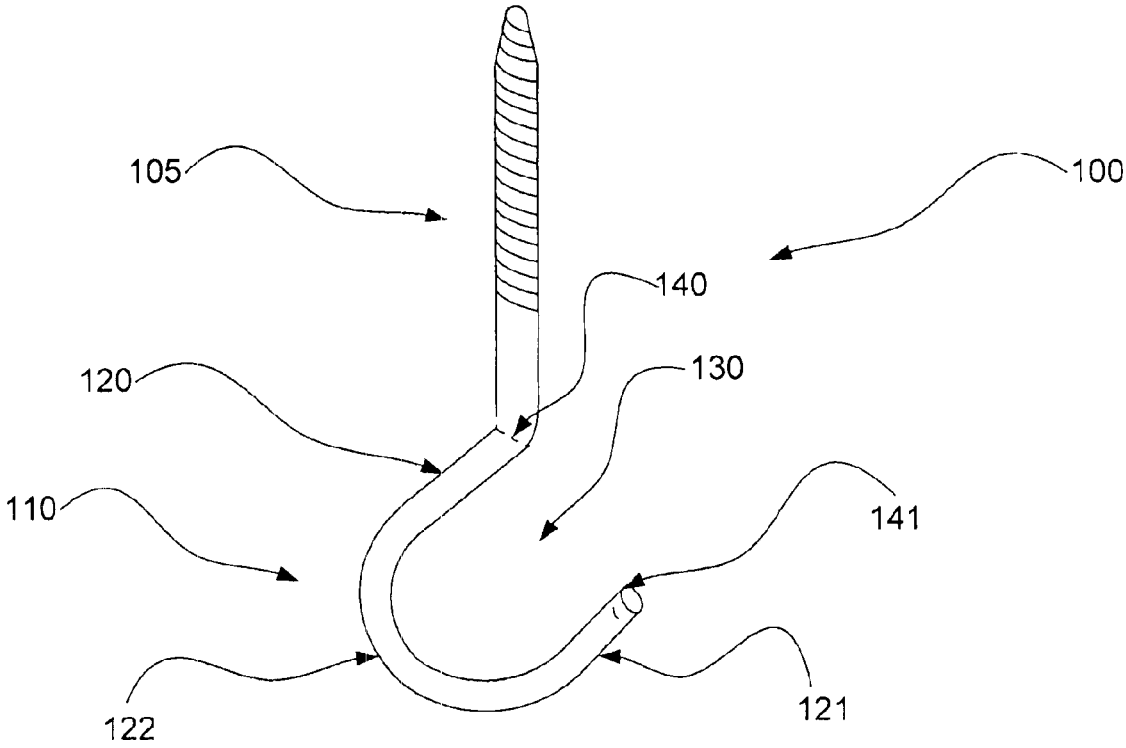
FIG. 1 (PRIOR ART)
FIG. 1 is a side view of a conventional screw hook.
Figure 2:
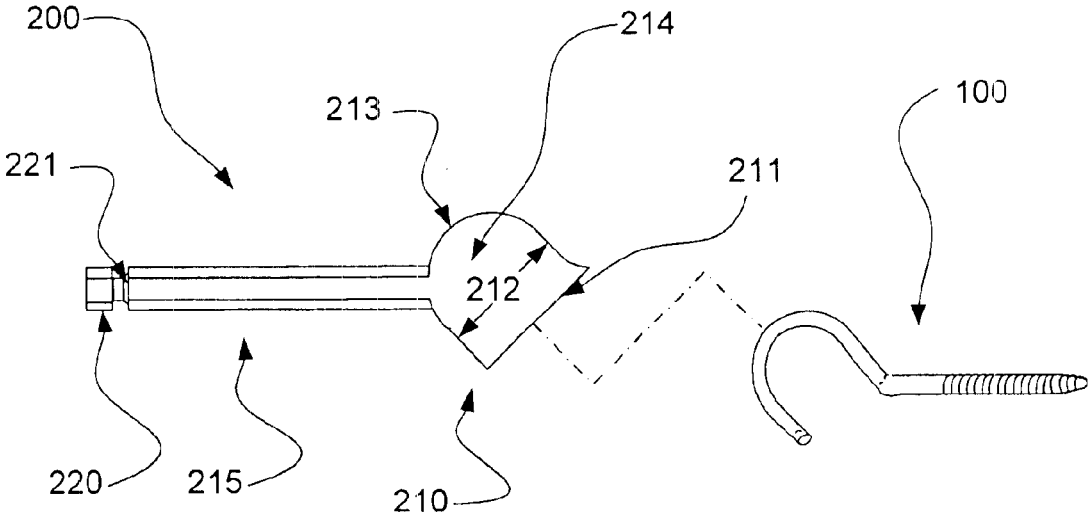
FIG. 2 is a side view of a screw hook and a screw hook socket according to an embodiment of the invention.

FIG. 2 is a side view of a screw hook 100 and a screw hook socket 200 according to an embodiment of the invention. The screw hook socket 200 comprises a drive shaft 215 and a socket 210. The drive shaft 215 is typically hexagonal such that it fits securely in the chuck of a common power drill (not shown). However, any shape, such as square or round, may be used for the shank 215 of the screw hook socket 200. Additionally, the drive shaft 215 may include a notched end 220 separated by a groove 221. The notched end 220 allows the screw hook socket 200 to be used with a typical "quick disconnect" interface with other tools, such as, for example, a ratchet, or an extension pole (also not shown).

In this embodiment, the screw hook socket 200 is designed to be used with a power drill. Thus, a hexagonal drive shaft 215 is shown that is operable to engage the chuck of a power drill. The drive shaft 215 is coupled to the socket 210 which is designed to engage a typical screw hook 100. The socket 200 includes a cavity or enclosure formed having a rectangular opening 211 formed by a first pair of parallel side walls 212 and a second pair of parallel side walls 214. The cavity includes an enclosed end formed by a U-shaped wall 213 that is opposite the rectangular opening 221. These same features can also be seen more easily in the isometric view of the screw hook socket 200 in FIG. 3 described below.

Still referring to FIG. 2, the rectangular opening 221 is sufficiently wide enough and long enough to allow a typical screw hook 100 to be inserted into the cavity. The cavity is defined in length by the first pair of parallel side walls 212, in width by the second pair of parallel side walls 214, and in depth by the U-shaped wall 213 wherein the two sets of parallel walls 212 and 214 are adjacent to the rectangular opening 211. The curved portion of the U-shaped wall 213 is opposite the rectangular opening 211. In this manner, the interior contour of the cavity of the socket 210 matches the contour of a typical screw hook 100.

Figure 3:
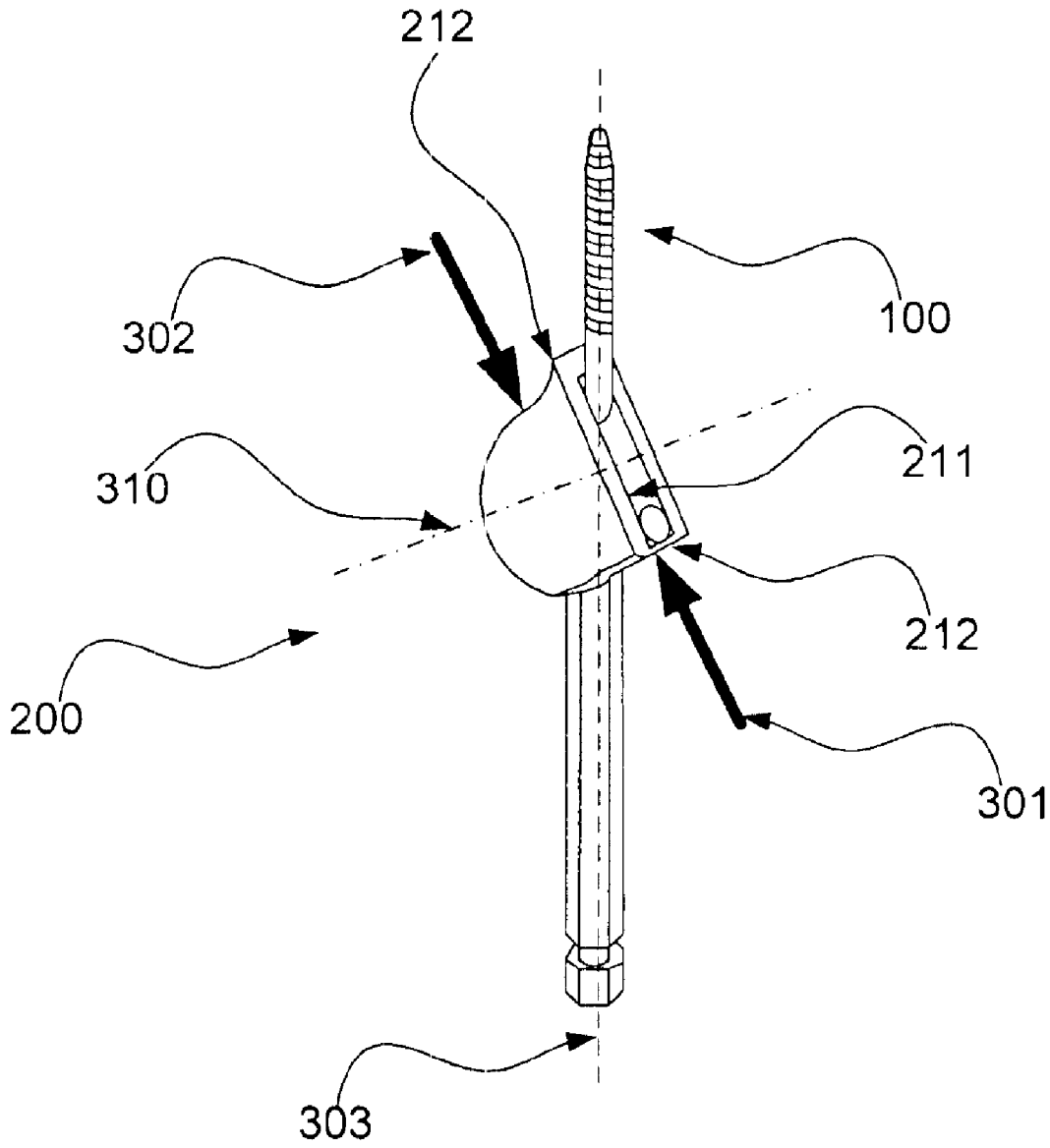
FIG. 3 is an isometric view of the screw hook socket of FIG. 2 engaged with the screw hook of FIG. 1 according to an embodiment of the invention.

FIG. 3 is an isometric view of the screw hook socket 200 of FIG. 2 engaged with a screw hook 100 according to an embodiment of the invention. As can be seen more readily in an isometric view, the rectangular opening 211 is defined in length by the first pair of parallel side walls 212 wherein the length is approximately the length from the tip 141 of a typical screw hook 100 to its bend point 140 on its shank 105. Further, the rectangular opening 211 is defined in width by the second pair of parallel side walls 214 wherein the width is approximately the diameter of the shank 105 of a typical screw hook 100.

The screw hook 100 in FIG. 3 is shown engaged with the screw hook socket 200. As such, the cavity of the screw hook socket 200 fits the contour of the hook portion 110 of the screw hook 100. When engaged, the screw hook 100 is prevented from rotating about any axis because of the cavity.

In the past, a screw hook 100 easily rotated about a horizontal axis 310 when one attempted to anchor the screw hook 100 to a wall. As can be seen in FIG. 3, the screw hook 100 is prevented from rotating on the horizontal axis 310 when engaged with the screw hook socket 200. If the screw hook 100 begins to rotate clockwise on the horizontal axis 310, a force 301 from the lower of the first pair of parallel side walls 212 is applied to the second straight run 121 of the screw hook 100. Likewise, if the screw hook 100 begins to rotate counter-clockwise on the horizontal axis 310, a force 302 from the upper wall of the first pair of parallel side walls 212 is applied to the first straight run 120 of the screw hook 100.

Unlike conventional tools for anchoring an object with a shank 105, the screw hook socket 200 applies the forces 301 and 302 at an angle that is not perpendicular to the longitudinal axis of the shank 105 of the screw hook 100. As such, the screw hook socket 200 is well suited for anchoring objects, such as the screw hook 100, that have straight runs 120 or 121 that are not parallel or perpendicular to the axis of rotation.

Still referring to FIG. 3, the cavity also prevents the screw hook 100 from rotating along the longitudinal axis 303 of the screw hook. The second pair of parallel side walls 214 prevents rotation about the longitudinal axis 303 by applying a force to the screw hook 100. Unlike the forces from the first pair of side walls 212, the forces from the second pair of sidewalls 214 are in a perpendicular direction to the longitudinal axis 303 as is the case with other conventional tools.

The size of the cavity may be suited to fit any size of screw hook 100. Typical screw hooks 100 have lengths that range from approximately 1 inch to 3 inches, diameters of the hook portion 110 that range from 0.5 inch to 1.5 inches, and thicknesses that range from 0.08 inch to 0.20 inch. The screw hook socket 200 is typically designed to fit one particular size of screw hook 100 in order to securely fit the contour of the hook portion 110 of the screw hook 100.

Figure 4:
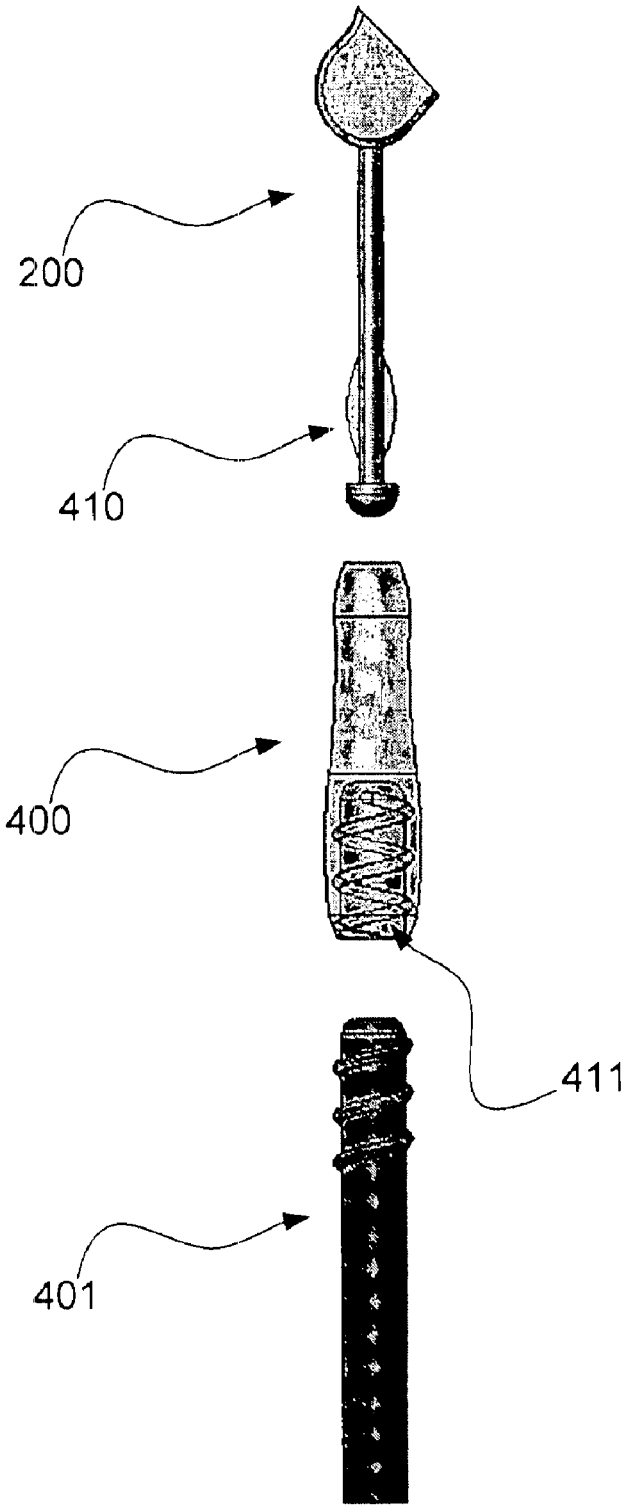
FIG. 4 is an exploded view of the screw hook socket of FIG. 2 with an extension pole mounting handle according to an embodiment of the invention.

FIG. 4 is an exploded view of the screw hook socket 200 of FIG. 2 with an extension pole mounting handle 400 according to an embodiment of the invention. In this embodiment, the screw hook socket 200 is designed to be mounted on an extension pole for use with working in more inaccessible places. The screw hook socket 200 includes a mounting bracket 410 designed to engage a receptacle 411 in an extension pole mounting handle 400. The extension pole mounting handle 400 is further designed to engage a typical extension pole 401. In one embodiment, the extension pole mounting handle 401 engages the extension pole 401 with threads. Other engagement mechanisms are contemplated but are not disclosed here for brevity.

By using an extension pole with the screw hook socket 200, one can reach more inaccessible places with the screw hook socket 200 for anchoring screw hooks. For example, screw hooks can be anchored on high ceilings or under awnings of a house using an extension pole 401 with a screw hook socket 200.

Other mounting options are contemplated for the screw hook socket 200 but are not shown in the drawings for brevity. For example, the screw hook socket 200 may be mounted in a conventional way to a typical ratchet or wrench. Further, the screw hook socket 200 may be used in conjunction with a drive mechanism, i.e. power drill, ratchet, extension pole, having a jointed drive shaft, i.e. a universal joint. As such, the rotational axis of the drive mechanism may be a different angle than that of the longitudinal axis of the screw hook 100.

From the foregoing it will be appreciated that, although specific embodiments of the invention have been described herein for purposes of illustration, various modifications may be made without deviating from the spirit and scope of the invention.

We claim:

1. A tool, comprising:

a drive shaft having a longitudinal axis and having a first end and a second opposite end; and a cavity attached to the first end of the drive shaft, the cavity having a substantially rectangular opening with a first side length longer than a second side length, the opening having a normal in a direction that is at a non-zero angle with respect to the longitudinal axis of the shaft, the cavity further defined by a pair of parallel side walls of the first side length and a U-shaped wall having two parallel walls adjacent to the opening and a curved portion of the U-shaped wall opposite the opening.

2. The tool of claim 1, further comprising a polygonal-shaped chuck attached to the second end of the drive shaft and operable to be engaged by a power drill.

3. The tool of claim 1, further comprising a polygonal-shaped chuck attached to the second end of the drive shaft and operable to be engaged by a ratchet.

4. The tool of claim 1, further comprising a handle attached to the second end of the drive shaft and operable to be engaged by a hand.

5. The tool of claim 1 wherein the opening of the cavity is at a first angle to the longitudinal axis of the drive shaft.

6. The tool of claim 5 wherein the opening of the cavity is at a second angle which is in a plane that is perpendicular to the axis of rotation of the first angle.

7. The tool of claim 1 wherein the cavity is operable to engage a screw hook.

8. The tool of claim 1, further comprising a universal joint attached between the first end of the drive shaft and the cavity.

9. A tool, comprising:

a drive shaft having a longitudinal axis and having a first end and a second opposite end; and an engaging enclosure having an opening wherein the normal of the opening is in a direction that is at a non-zero angle with respect to the longitudinal axis of the drive shaft, the engaging enclosure attached to the first end of the drive shaft and operable to engage an object wherein the engaging enclosure applies a substantially equal and opposite forces to the object at an angle other than perpendicular to the longitudinal axis when the object is rotated about an axis perpendicular to the longitudinal axis.

10. The tool of claim 9 wherein the angle of the equal and opposite forces is approximately 45 degrees from the longitudinal axis.

11. The tool of claim 9 wherein the size of the opening is sufficient to engage a screw hook having parallel straight runs in a hook portion such that the equal and opposite forces are applied to the parallel straight runs of the screw hook.

12. A method, comprising:

engaging an object with a tool having a cavity attached to a first end of a drive shaft having a longitudinal axis, the cavity having a substantially rectangular opening with a first side length longer than a second side length, the opening having a normal in a direction that is at a non-zero angle with respect to the longitudinal axis of the shaft, the cavity further defined by a pair of parallel side walls of the first side length and a U-shaped wall having two parallel walls adjacent to the opening and a curved portion of the U-shaped wall opposite the opening; and rotating the object about the longitudinal axis.

13. The method of claim 12, further comprising providing the rotating by means of a power drill.

14. The method of claim 12, further comprising providing the rotating by means of a handle.

15. The method of claim 12, further comprising providing the rotating by means of a ratchet.

* * * * *